US011259585B2

(12) United States Patent
Yeh et al.

(10) Patent No.: US 11,259,585 B2
(45) Date of Patent: Mar. 1, 2022

(54) HAT WITH FLEXIBLE PANELS

(71) Applicants: Ching-Hsiu Yeh, Taichung (TW); Hsing-Chi Yeh, Taichung (TW)

(72) Inventors: Ching-Hsiu Yeh, Taichung (TW); Hsing-Chi Yeh, Taichung (TW)

( * ) Notice: Subject to any disclaimer, the term of this patent is extended or adjusted under 35 U.S.C. 154(b) by 6 days.

(21) Appl. No.: 16/939,067

(22) Filed: Jul. 27, 2020

(65) Prior Publication Data

US 2021/0298405 A1 Sep. 30, 2021

(30) Foreign Application Priority Data

Mar. 25, 2020 (TW) ..... 109203429

(51) Int. Cl.
*A42B 1/208* (2021.01)
*A42B 1/0182* (2021.01)
*A42C 1/00* (2006.01)

(52) U.S. Cl.
CPC ..... *A42B 1/208* (2013.01); *A42B 1/0182* (2021.01); *A42C 1/00* (2013.01)

(58) Field of Classification Search
CPC ..... A42B 1/00; A42B 1/004; A42B 1/018; A42B 1/0183; A42B 1/0184; A42B 1/019; A42B 1/0192; A42B 1/04; A42B 1/045; A42B 1/201; A42B 1/205; A42B 1/206; A42B 1/22; A42B 1/24; A42B 1/248; A42B 1/208
See application file for complete search history.

(56) References Cited

U.S. PATENT DOCUMENTS 397,065 A * 1/1889 Brigham ..... A42B 1/22 2/175.3
919,984 A * 4/1909 Powe ..... A42B 1/006 2/209.11
945,268 A * 1/1910 Powell et al. ..... A42B 1/02 2/175.1
1,056,391 A * 3/1913 Baldwin ..... A42B 1/045 2/204
1,531,394 A * 3/1925 Ridgeway ..... A42B 1/12 2/68
1,623,768 A * 4/1927 Williams ..... A42B 1/24 43/57.1
1,684,610 A * 9/1928 Weir ..... A42B 1/22 2/181
D90,197 S * 6/1933 Lish ..... D2/865
2,172,510 A * 9/1939 Jaccard ..... A42B 1/208 2/209.3
3,072,916 A * 1/1963 Henderson ..... A42B 1/04 2/209.11
D350,221 S * 9/1994 Van Doren ..... D2/866
6,543,061 B1 * 4/2003 Morgan ..... A42B 1/22 2/183

(Continued)

*Primary Examiner* — F Griffin Hall

(57) ABSTRACT

A hat includes a main part which includes a visor, a peripheral portion and multiple panels formed thereto. The panels extend from the peripheral portion. A protrusion protrudes from the visor and contacts the outside of the peripheral portion. Multiple first holes are respectively defined through each of two lateral sides of each panel, the bottom side of the peripheral portion and the inner side of the visor. Multiple ropes extend through the first holes to connect the panels, the peripheral portion and the visor to form the hat.

10 Claims, 11 Drawing Sheets

(56) References Cited

U.S. PATENT DOCUMENTS

| | | | | | |
|---|---|---|---|---|---|
| 7,073,207 | B2 * | 7/2006 | Kim | A42B 1/004 | 2/195.1 |
| D541,013 | S * | 4/2007 | Kim | D2/882 | |
| D558,432 | S * | 1/2008 | Kim | D2/882 | |
| D600,891 | S * | 9/2009 | Fountain | D2/866 | |
| 7,707,657 | B2 * | 5/2010 | Kim | A42B 1/004 | 2/209.12 |
| D638,613 | S * | 5/2011 | Romo | D2/889 | |
| D657,117 | S * | 4/2012 | Burwell | D2/882 | |
| D797,411 | S * | 9/2017 | Shedd | D2/882 | |
| D863,733 | S * | 10/2019 | Konopka | D2/882 | |
| 2019/0231013 | A1 * | 8/2019 | Thomas | A42B 1/02 | |

* cited by examiner

HAT WITH FLEXIBLE PANELS

BACKGROUND OF THE INVENTION

1. Fields of the Invention

The present invention relates to a hat, and more particularly, to a hat composed of flexible panels by ropes and suitable for children.

2. Descriptions of Related Art

Hats in the market are mostly designed for youths or adults, and hats are rarely designed for children. Actually there are multiple important factors when making a hat for children, especially safety and comfort. The hats for children usually have a simple structure which cannot meet requirements of safety and comfort, so that children tend to remove the hats from their heads. Furthermore, the material for the existed children hats do not absorb shocks.

The present invention intends to provide a hat that is composed by panels which can be assembled to each other by ropes. The parents and the children can assemble the hat together to provide fun during assembling the hat.

SUMMARY OF THE INVENTION

The present invention relates to a hat which comprises a main part which is a planar part and includes a visor, a peripheral portion and multiple panels formed thereto. The peripheral portion is an elongate portion and is circled to form an insert entrance. The panels extend from the top of the peripheral portion. The width of each of the panels gradually reduced from the root portion toward the tip portion thereof. The tip portion of each panels is bent toward the top point of the hat. A room for accommodating the wearer's head is formed between the multiple panels and the peripheral portion. The visor includes a curved outer side and an inner side, wherein two ends of the visor are formed with the bottom side of the peripheral portion. A protrusion protrudes from the inner side of the visor and toward the peripheral portion. The protrusion is bent to contact the outside of the peripheral portion. Multiple first holes are respectively defined through each of two lateral sides of each panel, the bottom side of the peripheral portion and the inner side of the visor. Multiple ropes extend through the first holes to, connect the panels, the peripheral portion and the visor to form the hat.

The present invention also provide a method for assembling a hat, and comprises the following steps:

a step of separation: removing a main part from a base plate, the main part including a visor, a peripheral portion and multiple panels formed thereto, the peripheral portion being an elongate portion, the width of each of the panels being reduced from a root portion toward a tip portion thereof, two ends of the visor formed with the bottom side of the peripheral portion, a protrusion protruding from an inner side of the visor and toward the peripheral portion, multiple first holes respectively defined through each of two lateral sides of each panel, the bottom side of the peripheral portion and the inner side of the visor;

a step of measuring: wrapping the peripheral portion to a wearer's head and cutting two ends of the peripheral portion;

a step of tying the panels: circling the peripheral portion to form an insert entrance, the visor located outside of the peripheral portion, extending multiple ropes through the first holes of the panels to assemble the panels toward each other, bending the panels to form a room with the peripheral portion, and a step of tying the peripheral portion: bending the visor upward, bending the protrusion upward relative to the visor, the protrusion contacting outside of the peripheral portion, extending the ropes through the first holes of the peripheral portion, the first holes of the visor and the first holes of the protrusion 111 to maintain the visor to be an angle relative to the peripheral portion.

It is noted that the step of tying the peripheral portion can be alternatively proceeded before the step of tying the panels or the step of measuring.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
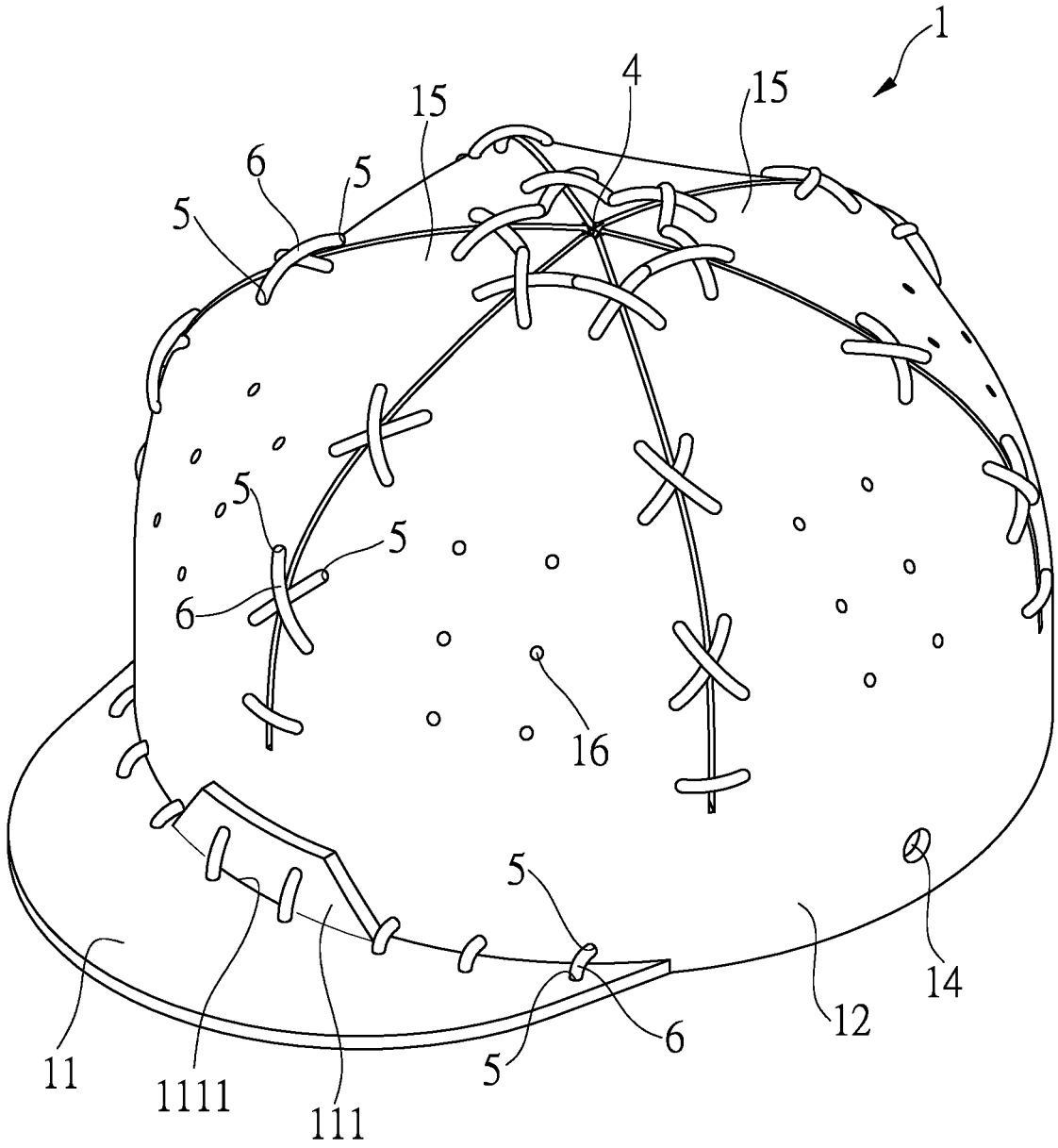
FIG. 1 is a perspective view to show the hat of the present invention.
Figure 2:
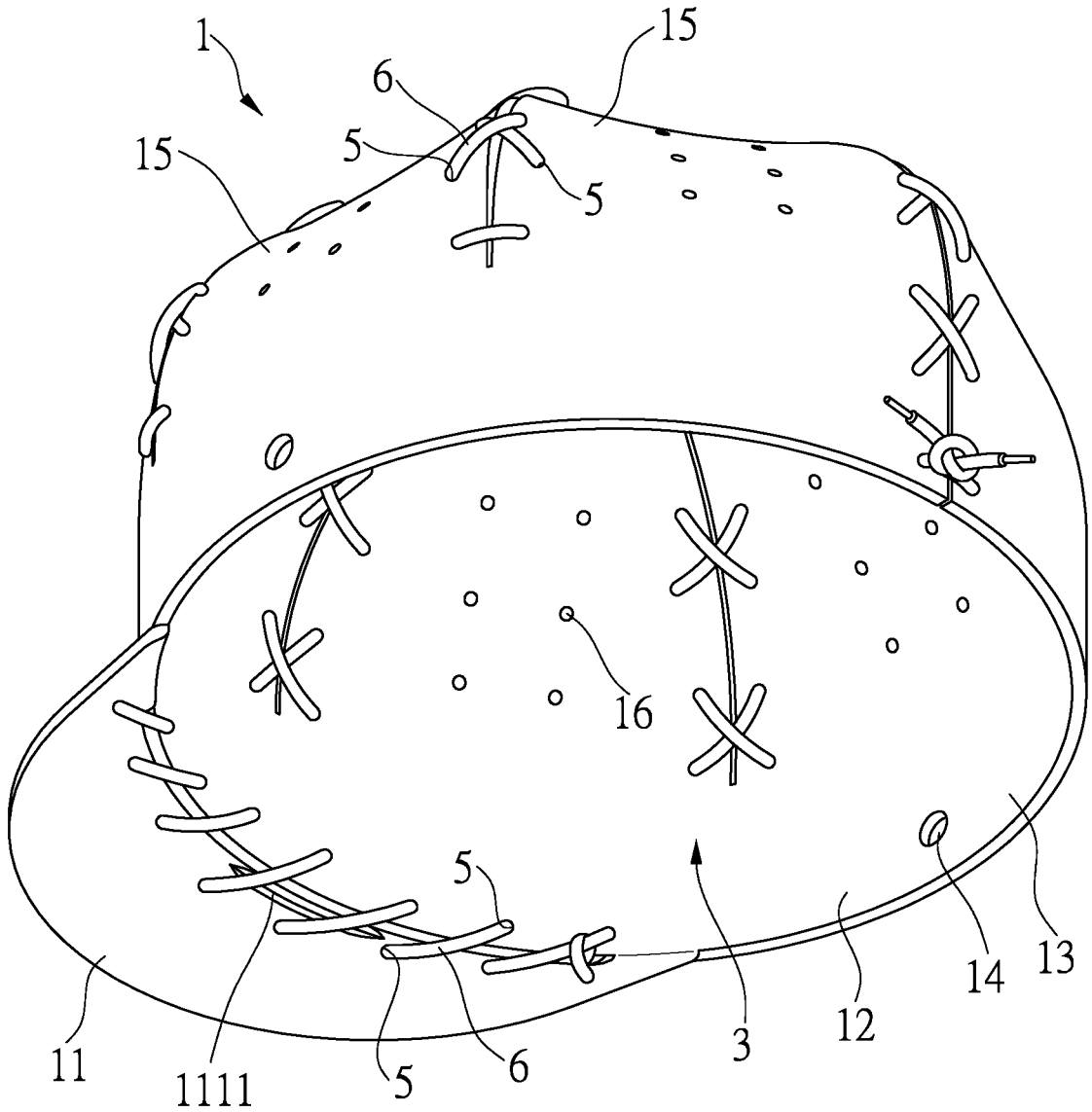
FIG. 2 is another perspective view to show the hat of the present invention.

Referring to FIGS. 1 and 2, the hat of the present invention comprises a main part 1 which is a planar part and made of soft material such as silicon rubber and foam rubber to absorb shocks. The main part 1 includes a visor 11, a peripheral portion 12 and multiple panels 15 formed thereto. The peripheral portion 12 is an elongate portion which is circled to form an insert entrance 13 from which the wearer's head is inserted into the hat. The panels 15 extend from the top of the peripheral portion 12. The width of each of the panels is gradually reduced from the root portion toward the tip portion thereof. The tip portion of each panels 15 is bent toward a top point 4 of the crown of the hat. A room 3 is therefore formed between the multiple panels 15 and the peripheral portion 12 such that the wearer's head is accommodated in the room 3. The visor 11 is a curved plate which includes a curved outer side and an inner side. Two ends of the visor 11 are formed with the bottom side of the peripheral portion 12. A protrusion 111 protrudes from the inner side of the visor 11 and toward the peripheral portion 12. The protrusion 111 is bent to contact the outside of the peripheral portion 12. Multiple first holes 5 are respectively defined through each of two lateral sides of each panel 15, the bottom side of the peripheral portion 12 and the inner side of the visor 11. The first holes 5 can be made by punching machine or made manually. Multiple ropes 6 extends through the first holes 5 to connect the panels 15, the peripheral portion 12 and the visor 11 to form the hat.

Figure 3:
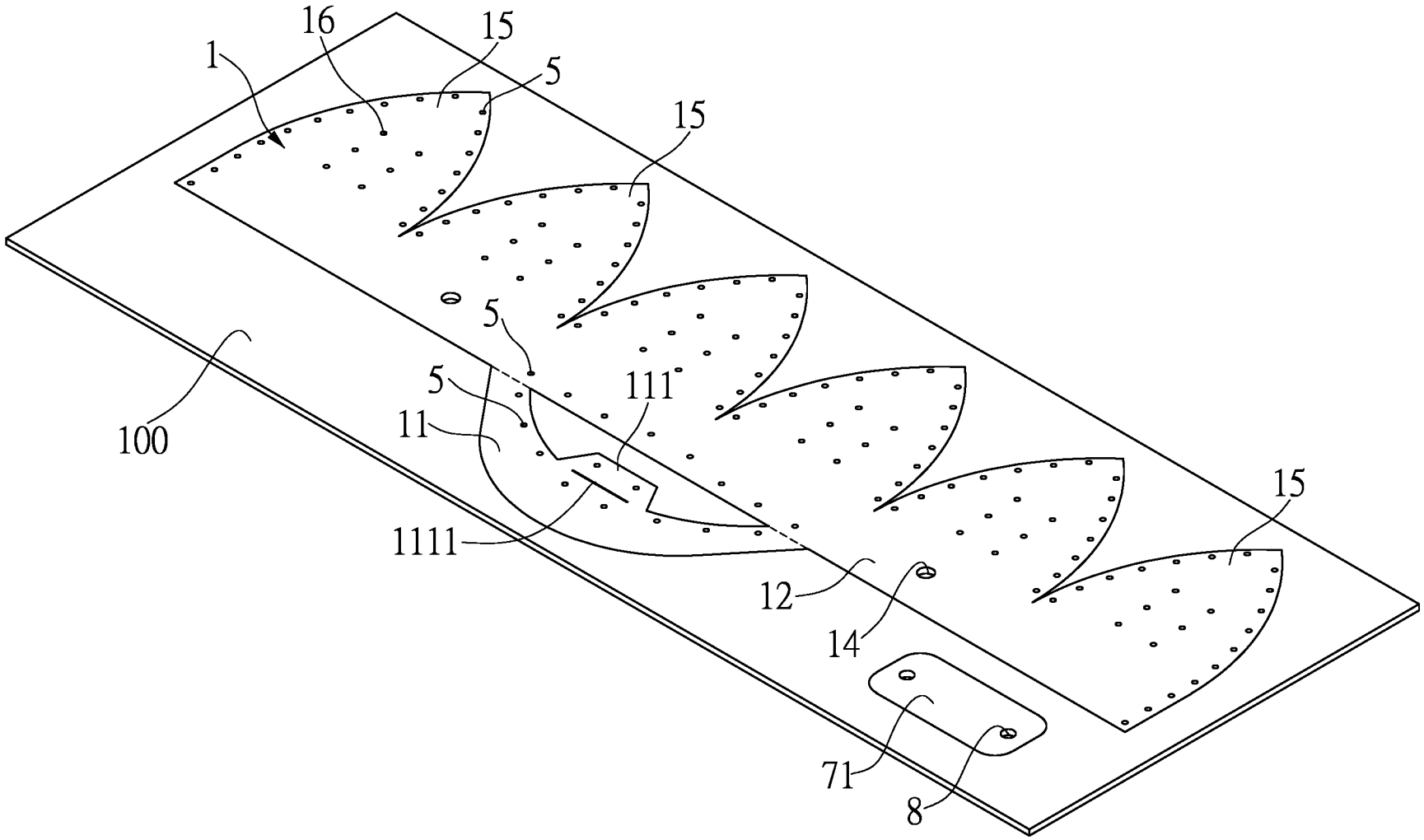
FIG. 3 shows that the main part is integral with the base plate.
Figure 4:
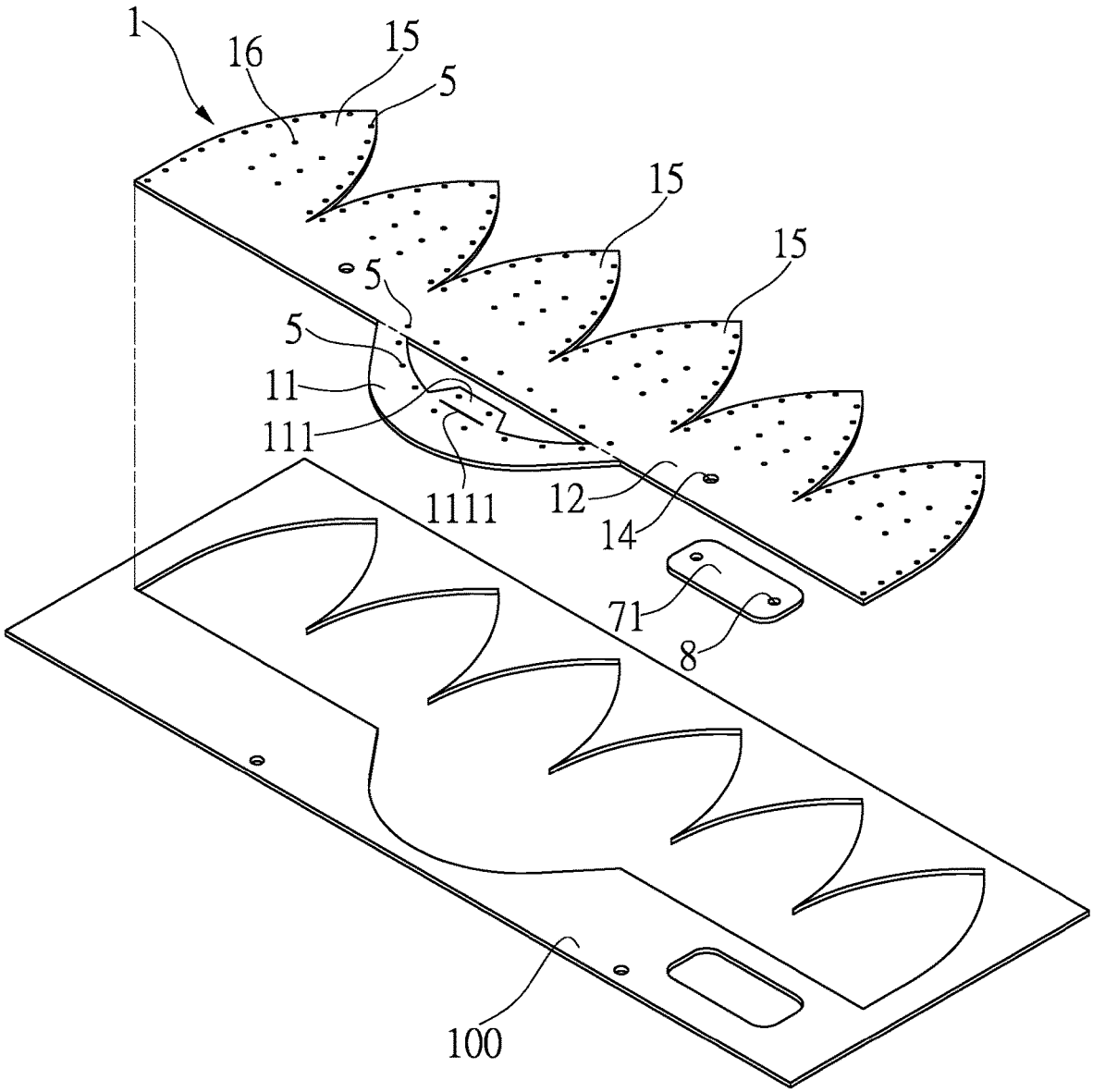
FIG. 4 shows that the main part is separated from the base plate.
Figure 5:
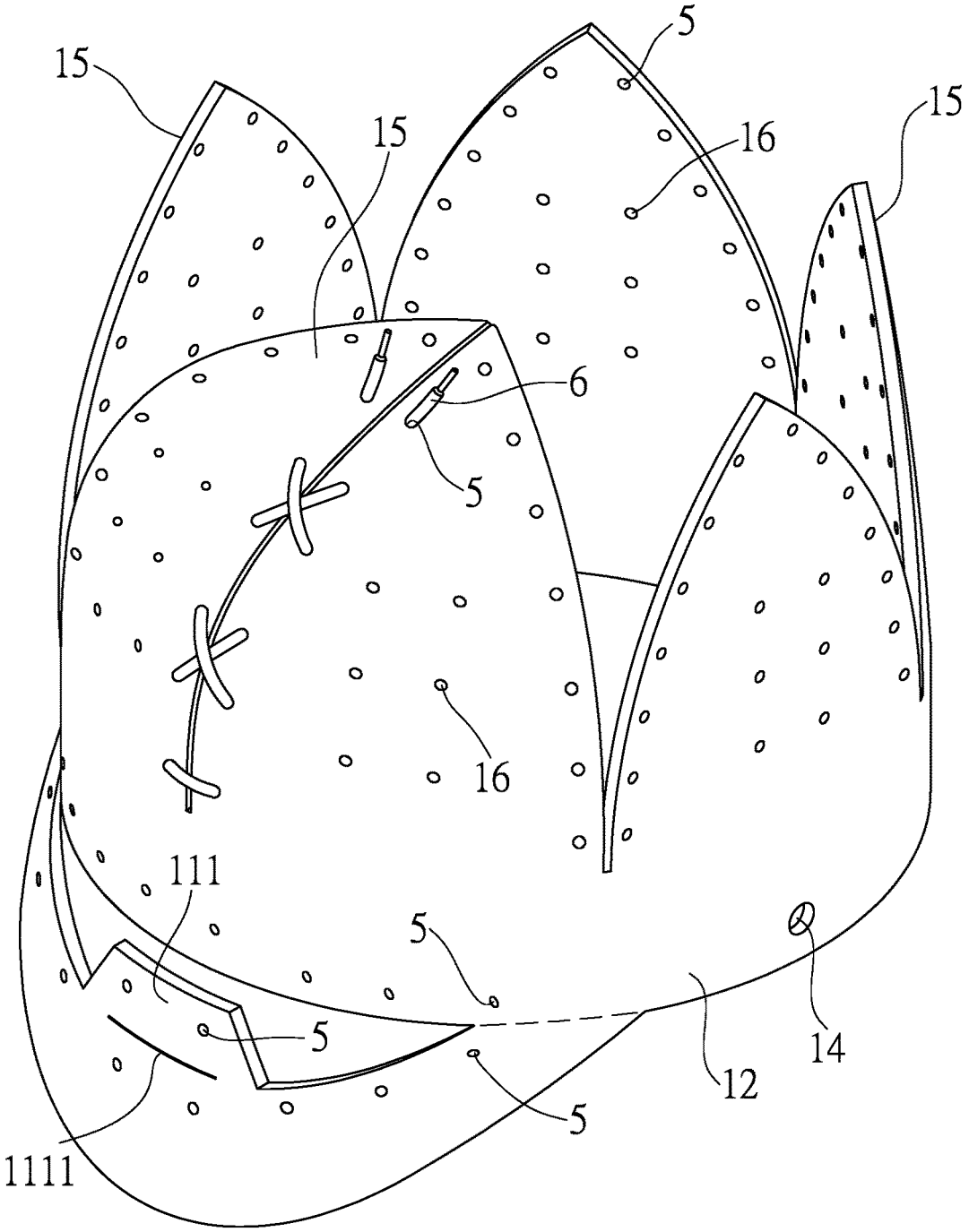
FIG. 5 shows that the ropes extend through the main part of the hat of the present invention.
Figure 6:
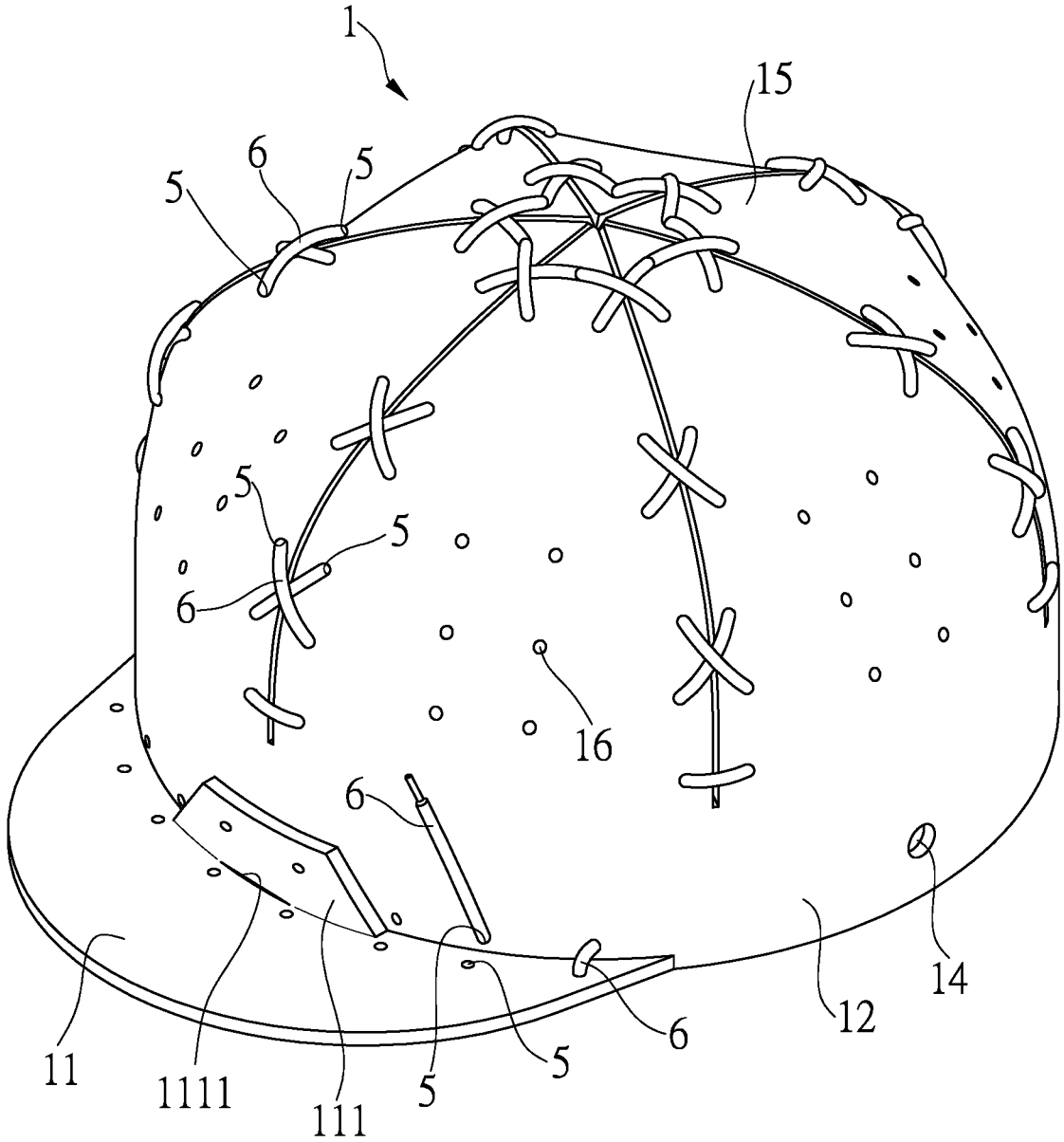
FIG. 6 shows another status of the hat wherein the ropes extend through the main part and the visor of the hat of the present invention.
Figure 8:
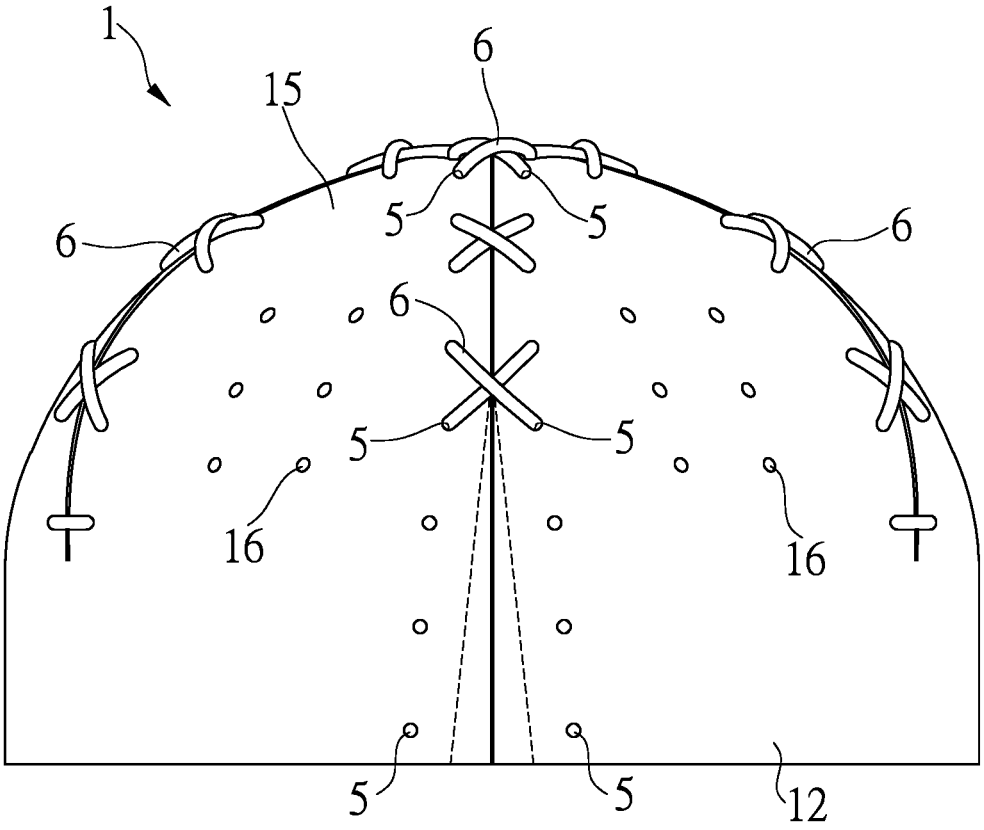
FIG. 8 shows that the two ends of the main part are cut to adjust the size of the hat.

The present invention also provide a method for assembling a hat, and comprises the following steps:

a step of separation: removing a main part 1 from a base plate 100 as shown in FIGS. 3 and 4;

a step of measuring: wrapping the peripheral portion 12 to a wearer's head and cutting two ends of the peripheral portion 12, the two ends of the main part 1 being cut as shown in FIG. 8 if the length of the main part 1 is longer than the size of the wearer's head;

a step of tying the panels: circling the peripheral portion 12 to form an insert entrance 13, the visor 11 located outside of the peripheral portion 12, extending multiple ropes 6 through the first holes 5 of the panels 15 to assemble the panels 15 toward each other as shown in FIGS. 2 and 5, bending the panels 15 to form a room 3 with the peripheral portion 12 shown in FIGS. 2 and 6, and a step of tying the peripheral portion: bending the visor 11 upward, bending the protrusion 111 upward relative to the visor 11, the protrusion 111 contacting outside of the peripheral portion 12 as shown in FIG. 6, extending the ropes 6 through the first holes 5 of the peripheral portion 12, the first holes 5 of the visor 11 and, the first holes 5 of the protrusion 111 to maintain the visor 11 to be an angle relative to the peripheral portion 12 as shown in FIG. 1 to form the hat.

It is noted that the step of tying the peripheral portion is alternatively proceeded before the step of tying the panels or the step of measuring.

Figure 7:
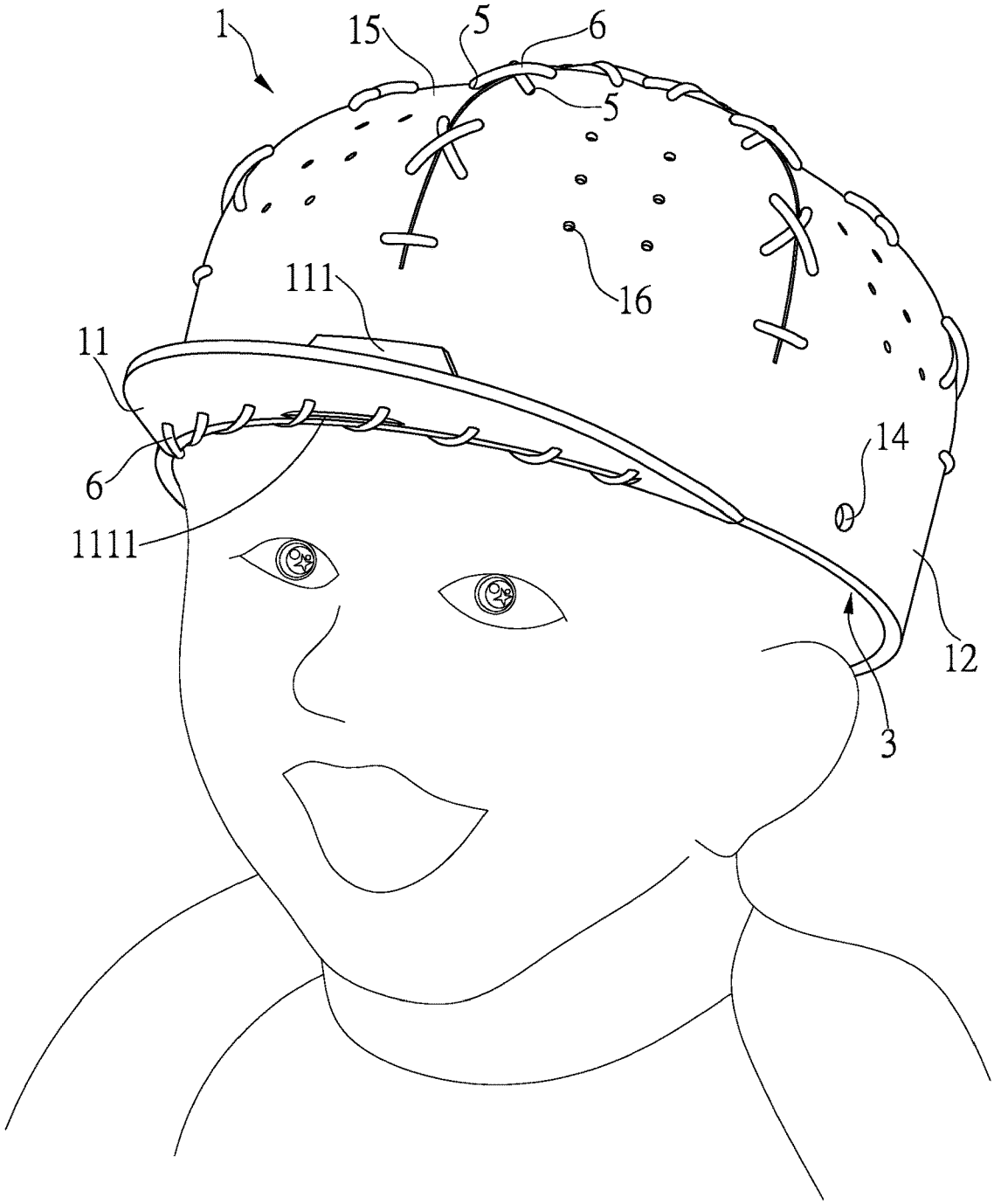
FIG. 7 shows that a child wears the hat of the present invention.

The ropes 6 can be helped by adults or parents to finish. The hat can be disassembled by removing the ropes 6 to form a planar main part 1 for convenience of storage. As shown in FIG. 7, the soft material of the main part 1 absorbs shocks to protect the child wearing the hat.

The protrusion 111 makes the visor 11 to be protruded forward. The protrusion 111 contacts the outside of the peripheral portion 12 ensures that the visor 11 does not flip upward when an impact is applied to the visor 11 from the bottom.

FIG. 8 shows that the two ends of the main part are cut along the dotted lines to adjust the room 3 of the hat.

Figure 9:
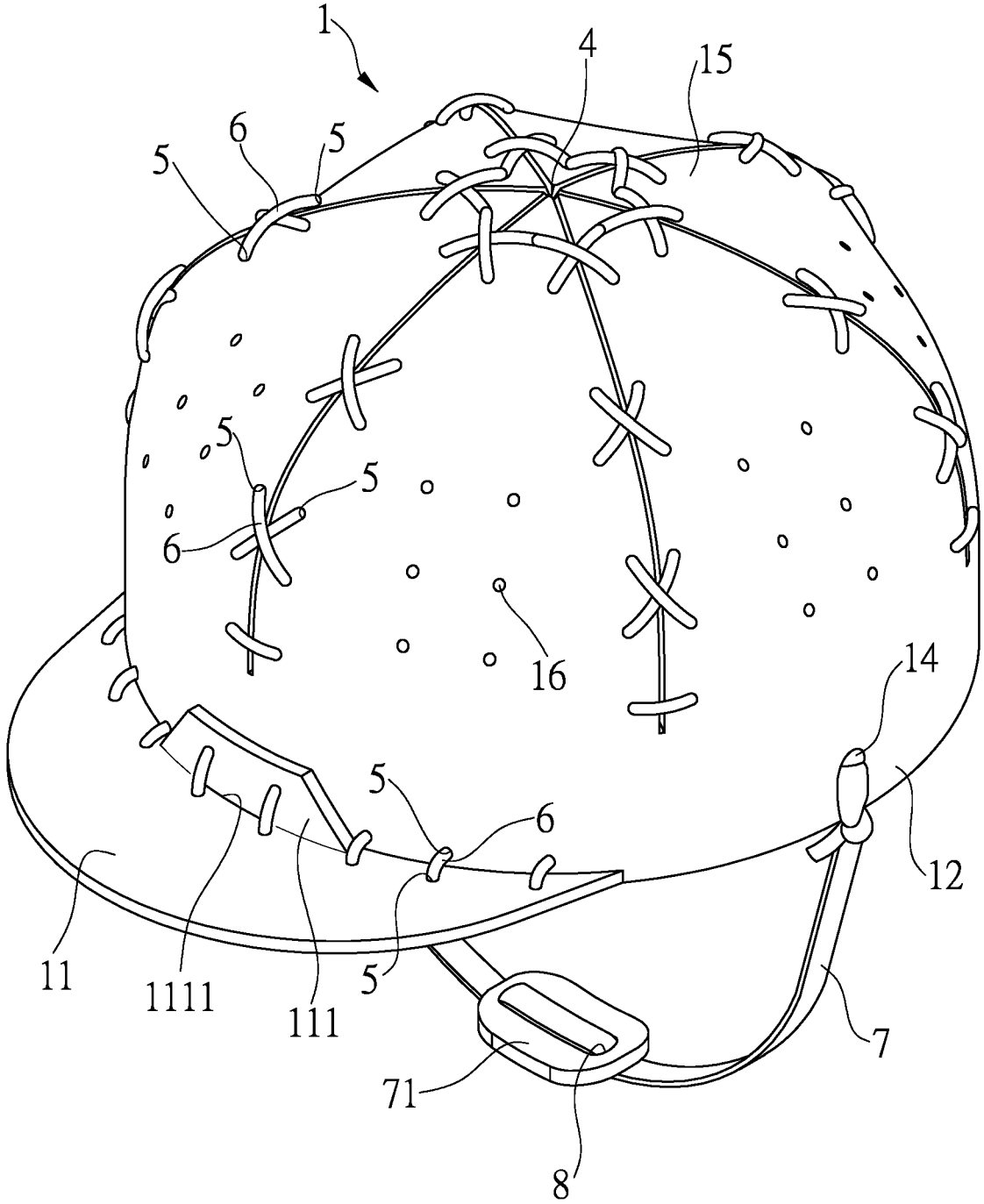
FIG. 9 shows that the hat of the present invention includes a strap.

As shown in FIGS. 3, 4 and 9, the hat may include a strap 7 and a chin pad 71. The chin pad 71 includes two passages 8 through which the strap 7 extends. Two second holes 14 are respectively defined through the peripheral portion 12 diametrically. The two ends of the strap 7 are tied to the two second holes 14.

The method mentioned above further comprises a step of tying the strap: forming the base plate 100 with the chin pad 71 which has the two passages 8, the strap 7 extending through the two passages 8, the two second holes 14 respectively defined through the peripheral portion 12 diametrically, two ends of the strap 7 being tied to the two second holes 14. The strap 7 ensures that the hat is worn in a stable status on the wear's head. The strap 7 is made of flexible material which is adjustable for different wearers.

Figure 11:
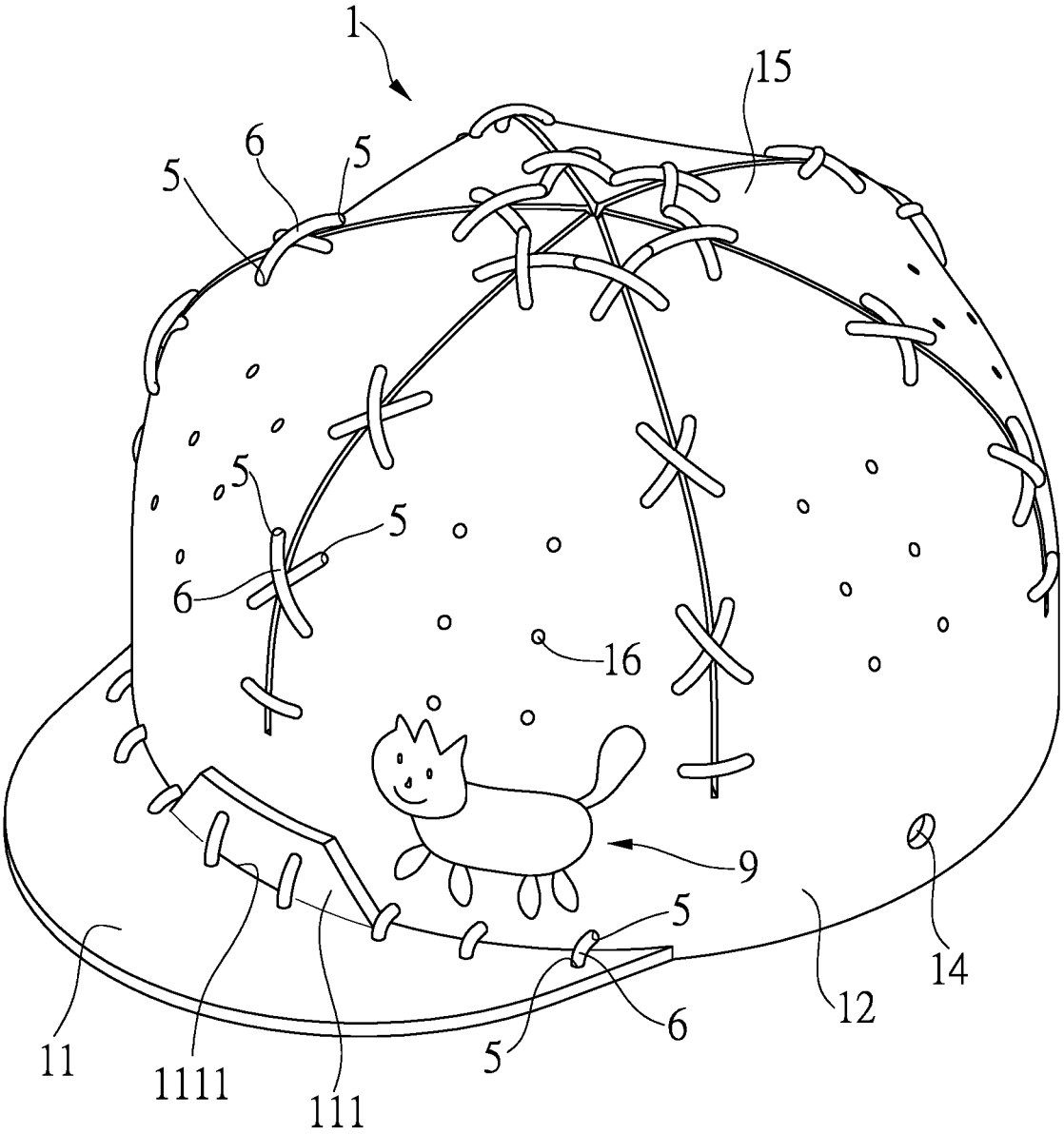
FIG. 11 shows the drawing area on the hat of the present invention.

As shown in FIG. 11, the main part 1 includes a drawing area 9 on the outside thereof. The method mentioned above further comprises a step of drawing: forming the drawing area 9 on the outside surface of the base plate 1, using coloring tools to draw figures or color onto the drawing area 9.

As shown in FIGS. 1 to 11, in order to have better air circulation, the multiple apertures 16 are defined through either of the panels 15 or the peripheral portion 12, or the multiple apertures 16 are defined through both of the panels 15 and the peripheral portion 12.

Figure 10:
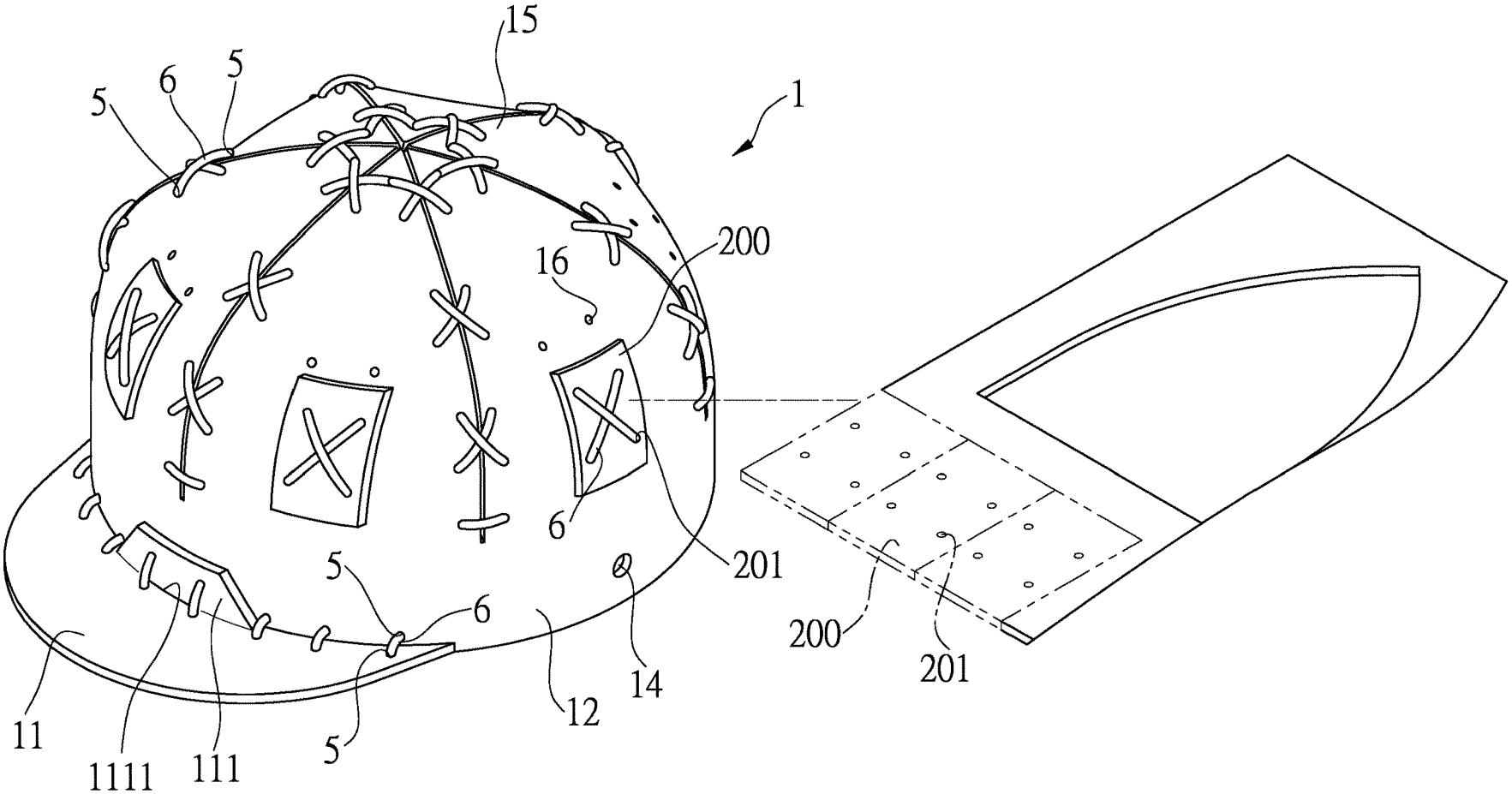
FIG. 10 shows that the hat of the present invention includes soft pads attached thereon.

As shown in FIG. 10, multiple soft pads 200 are connected to outside of either of the panels 15 or the peripheral portion 12, or the multiple soft pads 200 are connected to the outside of both of the panels 15 and the peripheral portion 12. Each of the soft pads 200 includes multiple bores 201, and the ropes 6 extend through the bores 201 and tie to the apertures 16. The method mentioned above further comprises a step of reinforcing the hat: cutting multiple soft pads 200 from the base plate 100, tying the soft pads 200 to either the peripheral portion 12 or the panels 15, or tying the soft pads 200 to both the peripheral portion 12 and the panels 15. The hat disclosed includes six apertures 16 in each panels 15, and each soft pad 200 includes 4 bores 201, so that the soft pads 200 can be attached to desired positions of the hat.

As shown in FIGS. 2 and 3, a gap 1111 is formed between the visor 11 and the protrusion 111. The gap 1111 allows the protrusion 111 easily to be bent.

While we have shown and described the embodiment in accordance with the present invention, it should be clear to those skilled in the art that further embodiments may be made without departing from the scope of the present invention.

What is claimed is:

1. A hat comprising:

a main part being a planar part and including a visor, a peripheral portion and multiple panels formed thereto, the peripheral portion being an elongate portion which is circled to form an insert entrance, the panels extending from a top of the peripheral portion, a width of each of the panels being reduced from a root portion toward a tip portion thereof, the tip portion of each panels being bent toward a top point of a crown of the hat, a room defined between the multiple panels and the peripheral portion, the visor having a curved outer side and an inner side, two ends of the visor formed with a bottom side of the peripheral portion, a protrusion protruding from the inner side of the visor and toward the peripheral portion, the protrusion being bent to contact an outside of the peripheral portion, multiple first holes respectively defined through each of two lateral sides of each panel, the bottom side of the peripheral portion and the inner side of the visor, and multiple ropes extending through the first holes to connect the panels, the peripheral portion and the visor to form the hat.

2. The hat as claimed in claim 1 further comprising a strap and a chin pad, the chin pad includes two passages through which the strap extends, two second holes are respectively defined through the peripheral portion diametrically, two ends of the strap are tied to the two second holes.

3. The hat as claimed in claim 1, wherein the main part includes a drawing area on an outside thereof.

4. The hat as claimed in claim 1, wherein multiple apertures are defined through either of the panels or the peripheral portion, or the multiple apertures are defined through both of the panels and the peripheral portion.

5. The hat as claimed in claim 4, wherein multiple soft pads are connected to an outside of the panels or the outside of the peripheral portion, or the multiple soft pads are connected to the outside of both of the panels and the peripheral portion, each of the soft pads includes multiple bores, the ropes extend through the bores and tie to the apertures.

6. The hat as claimed in claim 1, wherein a gap is formed between the visor and the protrusion.

7. A method for assembling a hat, comprising:

a step of separation: removing a main part from a base plate, the main part including a visor, a peripheral portion and multiple panels formed thereto, the peripheral portion being an elongate portion, a width of each of the panels being reduced from a root portion toward a tip portion thereof, two ends of the visor formed with a bottom side of the peripheral portion, a protrusion protruding from an inner side of the visor and toward the peripheral portion, multiple first holes respectively defined through each of two lateral sides of each panel, the bottom side of the peripheral portion and the inner side of the visor;

a step of measuring: wrapping the peripheral portion to a wearer's head and cutting two ends of the peripheral portion;

a step of tying the panels: circling the peripheral portion to form an insert entrance, the visor located on an outside of the peripheral portion, extending multiple ropes through the first holes of the panels to assemble the panels toward each other, bending the panels to form a room with the peripheral portion, and a step of tying the peripheral portion: bending the visor upward, bending the protrusion upward relative to the visor, the protrusion contacting the outside of the peripheral portion, extending the ropes through the first holes of the peripheral portion, the first holes of the visor and the first holes of the protrusion to maintain the visor to be at an angle relative to the peripheral portion, wherein the step of tying the peripheral portion is alternatively proceeded before the step of tying the panels or the step of measuring.

8. The method as claimed in claim 7 further comprising a step of tying a strap: forming the base plate with a chin pad which has two passages, the strap extends through the two passages, two second holes respectively defined through the peripheral portion diametrically, two ends of the strap being tied to the two second holes.

9. The method as claimed in claim 7 further comprising a step of reinforcing the hat: cutting multiple soil pads from the base plate, tying the soft pads to either the peripheral portion or the panels, or tying the soft pads to bath the peripheral portion and the panels.

10. The method as claimed in claim 7 further comprising a step of drawing: forming a drawing area on a surface of the base plate, using coloring tools to draw figures or color onto the drawing area.

* * * * *